US005829518A

United States Patent [19]

Gano et al.

[11] Patent Number: 5,829,518

[45] Date of Patent: Nov. 3, 1998

[54] MILL GUIDE AND ANCHOR ASSEMBLY FOR SUBTERRANEAN WELL CASINGS

[75] Inventors: John C. Gano; Pat M. White, both of Carrollton, Tex.

[73] Assignee: Halliburton Energy Services, Inc., Dallas, Tex.

[21] Appl. No.: 779,146

[22] Filed: Jan. 3, 1997

Related U.S. Application Data

[63] Continuation-in-part of Ser. No. 759,508, Dec. 5, 1996.

[51] Int. Cl.[6] ..... E21B 23/01

[52] U.S. Cl. ..... 166/55.7; 166/117.6

[58] Field of Search ..... 166/120, 123, 166/117.6, 134, 182, 55.7

[56] References Cited

U.S. PATENT DOCUMENTS

| | | | |
|---|---|---|---|
| 3,714,983 | 2/1973 | Wilson | 166/120 |
| 4,436,150 | 3/1984 | Barker | 166/123 X |
| 4,637,469 | 1/1987 | Spriggs et al. | 166/72 X |
| 5,103,902 | 4/1992 | Ross et al. | 166/120 |
| 5,113,939 | 5/1992 | Ross et al. | 166/120 |
| 5,501,281 | 3/1996 | White et al. | 166/387 |

*Primary Examiner*—Frank Tsay
*Attorney, Agent, or Firm*—Paul I. Herman; J. Richard Konneker

[57] ABSTRACT

A retrievable mill guide and anchor assembly is provided for use in forming a side wall window in a vertical subterranean well casing for subsequent connection to the casing of a lateral bore liner member extending through the casing window. The mill guide extends upwardly from the top end or the anchor. With the assembly in its run-in orientation, a milling pipe with a first mill bit on its lower end is releasably locked within the upper mill guide end, and pressurized fluid within the milling pipe is used to hydraulically set the anchor in the casing. After the anchor is set, the first mill bit is rotated, lowered and deflected by the mill guide to engage and form an initial opening in the casing side wall. The milling pipe is then removed from the casing, the first mill bit is replaced with a second mill bit, and a specially designed retrieval collet is installed on the milling pipe. The milling pipe is then lowered into the casing, and the second mill bit is used in conjunction with the mill guide to enlarge the casing side wall opening to the final desired window size. The retrieval collet is then latched into the upper mill guide end and pulled up to sequentially release the anchor and pull the mill guide and anchor assembly out of the casing with the milling pipe.

21 Claims, 8 Drawing Sheets

MILL GUIDE AND ANCHOR ASSEMBLY FOR SUBTERRANEAN WELL CASINGS

CROSS-REFERENCE TO RELATED APPLICATION

This application is a continuation-in part of U.S. application Ser. No. 08/759,508 filed on Dec. 5, 1996 and entitled "MILL GUIDE ANCHOR APPARATUS AND ASSOCIATED METHODS".

BACKGROUND OF THE INVENTION

The present invention generally relates to the art of completing subterranean wells and, in a preferred embodiment thereof, more particularly relates to apparatus and methods for milling a side wall window in a parent wellbore casing in preparation for subsequently extending a lateral wellbore from the parent wellbore.

It is well known in the art of drilling subterranean wells to form a parent bore into the earth and then to form one or more bores extending laterally therefrom. Generally, the parent bore is first cased and cemented, and then a tool known as a whipstock is positioned in the parent bore casing atop an anchor structure locked into place in the parent wellbore casing. The whipstock is specially configured to deflect a drill bit in a desired direction for forming a lateral bore. The drill bit is then lowered into the parent bore suspended from drill pipe and is radially outwardly deflected by the whipstock to drill a window in the parent bore casing and cement. Directional drilling techniques may then be employed to direct further drilling of the lateral bore as desired.

The lateral bore is then cased by inserting a tubular liner from the parent bore, through the window previously cut in the parent bore casing and cement, and then into the lateral bore. In a typical lateral bore casing operation, the liner extends somewhat upwardly into the parent bore casing and through the window when the casing operation is finished. In this way, an overlap is achieved wherein the lateral bore liner is received in the parent bore casing above the window.

Several whipstock/anchor structures have been previously proposed for use in cutting the side wall window in the parent wellbore casing to facilitate the subsequent addition of a lateral wellbore thereto. Each of these structures, however, has one or more disadvantages which make its use inconvenient or uneconomical. Some of these disadvantages include inaccurate positioning and orienting of the window opening to be cut, complexity in setting and releasing portions of the window forming apparatus, undesirable torque-created rotational shifting of the apparatus, and danger of leaving portions of the apparatus in the well necessitating a subsequent fishing operation.

From the foregoing it can be seen that it would be quite desirable to provide improved apparatus and methods for forming a side wall window opening in a parent wellbore casing which are convenient and economical to use, which provide accurate positioning and orienting of the opening to be cut, which have setting and release reliability, are not complex from setting and release standpoints, and which reduce the danger of leaving portions of the apparatus in the well. It is accordingly an object of the present invention to provide such improved apparatus and associated methods for forming a casing side wall window opening.

SUMMARY OF THE INVENTION

In carrying out principles of the present invention, in accordance with a preferred embodiment thereof, a specially designed tubular anchor assembly with an elongated mill guide projecting upwardly from its top end is used in conjunction with a pipe-supported mill bit to mill out a casing side wall window in a generally vertical parent wellbore to permit the subsequent is connection of a lateral wellbore thereto. To facilitate the efficiency of the milling operation and the retrieval from the casing of the anchor assembly, a specially designed tubular retrieval structure is also provided.

According to one milling method of the invention a tubular anchor structure is provided and has a top end from which the elongated mill guide longitudinally projects. Along its length the upwardly projecting mill guide has a mill bit deflection surface positioned thereon and angled relative to the longitudinal axis of the tubular anchor structure. The tubular anchor structure is coaxially and releasably locked within the casing somewhat below the casing side wall portion to be milled out to form the desired window.

A length of milling pipe is provided and has a bottom end to which a mill bit is secured, a radially outwardly extending outer side projection disposed above the mill bit, and a tubular retrieval structure coaxially and releasably secured to the milling pipe above its outer side projection.

At least a portion of the casing side wall window is milled out by lowering the mill bit end of the milling pipe through a tubular fishing neck secured to a tubular upper end portion of the mill guide, rotating the milling pipe, and laterally deflecting the rotating mill bit into cutting engagement with the casing side wall by bringing the rotating mill bit into contact with the mill guide deflection surface. Next, the milling pipe is pushed further downwardly to responsively cause the retrieval structure to enter and become latched within the fishing neck.

Next, the tubular anchor structure is retrieved on the milling pipe by upwardly pulling the milling pipe out of the casing and sequentially (1) causing the milling pipe to break free from the retrieval structure and move upwardly through the retrieval structure, and (2) causing the milling pipe outer side projection to upwardly abut an interior portion of the retrieval structure and responsively create in the tubular anchor structure an upward force that unlocks the anchor structure from the casing and permits it to be pulled out of the casing with the retrieval structure, the fishing neck and the mill guide.

The tubular anchor structure and associated mill guide and retrieval structure may be used to progressively mill out the casing side wall window using, for example, first and second differently configured mill bits used in first and second milling pipe run-ins. On the first of these run-ins the milling pipe is releasably secured coaxially within the tubular upper end portion of the milling guide, with the interior of the milling pipe being communicated with the interior of a setting piston pressure chamber within the anchor structure via a passage structure extending from the milling pipe through the mill guide. When the anchor assembly is appropriately positioned within the casing pressurized fluid is forced through the milling pipe and into the anchor assembly pressure chamber to cause movement of the setting piston and responsively cause slip portions of the anchor assembly to grip the casing and releasably lock the anchor assembly therein. On the last milling pipe run-in (illustratively the second run-in) the retrieval structure is used to release and remove the anchor structure and its upwardly projecting mill guide.

The tubular anchor assembly is uniquely configured to provide it with a desirable thin sidewall configuration and substantially enhanced retrievability. In a preferred embodiment thereof the anchor assembly comprises a tubular inner mandrel, upper and lower tubular slip carriers coaxially circumscribing the tubular inner mandrel in radially outwardly spaced relationships therewith, and circumferentially spaced series of upper and lower toothed slips respectively positioned between the upper and lower slip carriers and the inner mandrel. The slips are radially movable through slip windows in their associated carriers between inwardly retracted release positions and outwardly extended setting or casing gripping positions.

According to one feature of the invention, the slips are resiliently biased toward their radially retracted release positions by a compact biasing structure including circumferentially spaced series of arcuate, elongated spring members disposed in the annular spaces between the slip carriers and the inner mandrel and interdigitated with the circumferentially spaced series of slips. The spring members have longitudinally central portions secured to their associated slip carrier, and outer end portions of the springs enter outer side recesses in the slips and slidingly engage the slips.

According to another feature of the invention which advantageously reduces the overall sidewall thickness of the tubular anchor assembly, radially inner side portions of the slips are slidably carried in axially spaced apart upper and lower circumferentially spaced series of axially extending pockets formed in the outer side surface of the inner mandrel.

The upper and lower slips are preferably in an opposing relationship, with a tubular wedge member coaxially and slidably circumscribing the inner mandrel between the facing toothed and ramped ends of the upper and lower slips. A ramped upper end portion of the wedge member has a continuous, solid annular configuration, while a circumferentially spaced series of axial sidewall slots extend upwardly through the lower wedge member end. The slots form a circumferentially spaced series of collet finger portions on the wedge member, with lower ends of the collet fingers having ramped configurations.

The inner mandrel, the upper and lower slips, and the colleted wedge member are relatively movable in axial directions between (1) a set position in which the outer ends of the collet finger portions outwardly overlie and are radially supported by nonpocketed areas of the inner mandrel, with the opposite ends of the wedge member rampingly engaging the tapered ends of the upper and lower slips, and (2) a release position in which the outer ends of the collet finger portions overlie the second series of inner mandrel pockets and may be radially deflected thereinto in response to an axially directed engagement force between the outer ends of the collet finger portions and the tapered ends of the second slips. In this manner, the release of the tubular anchor assembly from the casing is substantially facilitated.

In a preferred embodiment thereof the retrieval structure comprises a tubular body having upper and lower ends, and a circumferentially spaced series of axially extending side wall slots formed in the body and having upper and lower ends respectively spaced axially inwardly of the upper and lower ends of the body. The slots form therebetween a circumferentially spaced series of axially extending collet fingers resiliently deflectable radially inwardly and outwardly relative to the balance of the body. Each of the collet fingers-has a radially outwardly extending outer side projection and a radially inwardly extending inner side projection.

The inner side collet finger projections have bottom faces which are upwardly and radially outwardly sloped at a first angle relative to a reference plane transverse to the longitudinal axis of the retrieval structure body; the outer side collet finger projections have top faces which are downwardly and radially outwardly sloped at a second angle relative to a reference plane transverse to the longitudinal axis of the retrieval structure body; and the outer side collet finger projections have bottom faces which are upwardly and radially outwardly sloped at a third angle relative to a reference plane transverse to the longitudinal axis of the retrieval structure body.

The first angle is less than the second angle which, in turn, is less than the third angle. Preferably, the first angle is approximately 10 degrees; the second angle is approximately 20 degrees; and the third angle is approximately 45 degrees.

Near the upper end of the fishing neck at the top of the mill guide is an annular side surface recess having an annular upper end ledge having a slope parallel to the slopes of the upper ends of the outer retrieval structure collet finger projections, and an annular lower end ledge having a slope parallel to the slopes of the lower ends of the outer retrieval structure collet finger projections. Because of these slope angles, the retrieval structure outer collet finger projections may be snapped into the fishing neck recess as the retrieval structure is inserted into the fishing neck, but are locked in the recess against upward removal therefrom. Accordingly, the retrieval collet structure is a "one way" structure that facilitates the releasing and removal of the anchor assembly from the casing.

The milling pipe preferably has an outwardly projecting annular flange thereon with an upper face that has a slope angle essentially to the slope angles on the bottom ends of the inner collet finger projections on the tubular retrieval structure. This milling pipe flange functions as a pickup abutment that upwardly engages the inner collet finger projections, during upward movement of the milling pipe after it has been disconnected from the tubular retrieval structure, to transmit a releasing force to the anchor assembly, via the retrieval structure, the fishing neck and the mill guide, and then upwardly carry the retrieval structure and attached fishing neck, mill guide and anchor assembly out of the casing with the balance of the milling pipe.

DETAILED DESCRIPTION

Figure 1A:
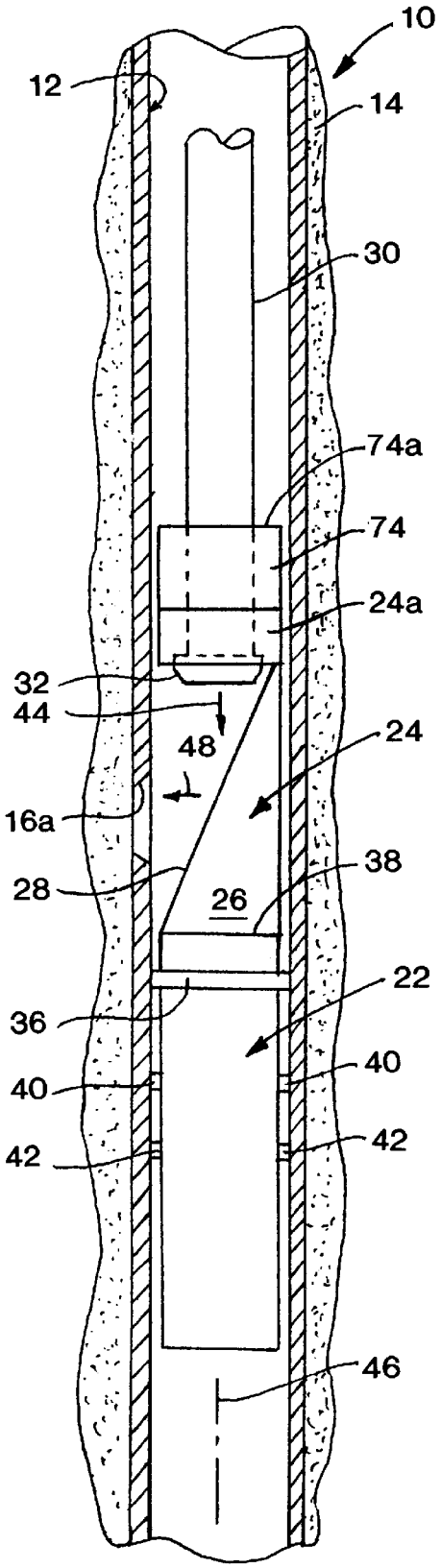
FIGS. 1A and 1B are highly schematic partly elevational cross-sectional views through a portion of a subterranean well and illustrate specially designed mill guide and anchor apparatus, embodying principles of the present invention, being used to form a side wall window in the well casing.
Figure 1B:
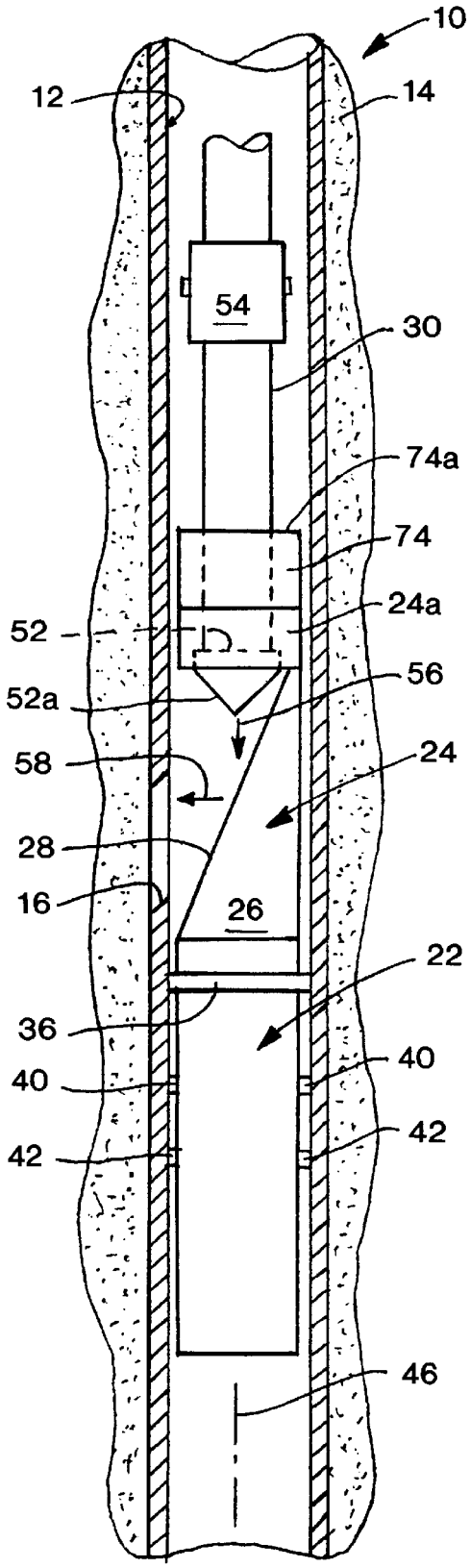
Figure 2:
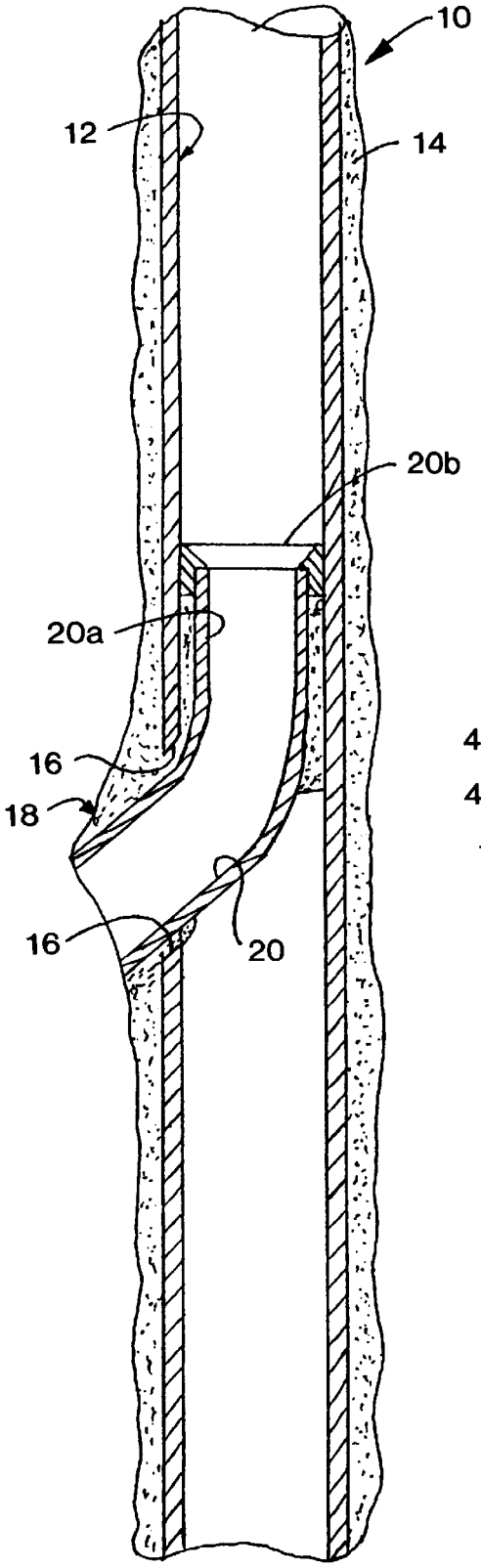
FIG. 2 is a highly schematic cross-sectional view through the subterranean well portion and illustrating an upper portion of a lateral bore liner operatively installed therein subsequent to the formation of the casing window.

Schematically illustrated in FIGS. 1A–2 is a first-drilled, or "parent", wellbore 10 which is generally vertically formed in the earth. The parent wellbore 10 is lined with a generally tubular and vertically oriented metal casing 12. Cement 14 fills an annular area radially between the casing 12 and the earth.

As a result of a milling operation subsequently described herein and embodying principles of the present invention, the parent wellbore 10 has a side wall window 16 formed through the casing 12 (see FIGS. 1B and 2). A lateral wellbore 18 extends outwardly from the window 16 and includes a tubular liner structure 20 with cement 14 filling the annular space radially between the liner 20 and the earth. Liner 20 has an upper longitudinal portion 20*a* coaxially extending upwardly through the parent bore wellbore casing 12 and has an open upper end 20*b* upwardly spaced apart from the casing window 16. The upper longitudinal liner portion 20*a* defined with the interior side surface of the casing 12 an annular space which is also filled with cement 14.

The present invention is directed to forming the side wall window opening 16 in the casing 12 as shown in FIG. 2. As will be subsequently described in greater detain herein, window 16 is formed utilizing a specially designed retrievable anchor assembly 22 (see FIGS. 1A and 1B) embodying principles of the present invention. Anchor assembly 22 has a hollow tubular configuration and has an elongated mill guide member 24 extending upwardly from the top end of the anchor assembly 22 in a laterally offset relationship with its longitudinal axis. Mill guide member 24 has a thickened lower end portion 26 having, as representatively illustrated in FIGS. 1A and 1B, a downwardly and leftwardly sloping guide surface 28 thereon.

FIGS. 1A and 1B, in highly schematic form, sequentially illustrate the use of the milling guide member 24, and its associated tubular anchor assembly 22, to form the casing window 16 shown in FIG. 2. Referring initially to FIG. 1A, the lower end of a tubular fishing neck 74 is coaxially secured to a tubular upper end portion 24*a* of the mill guide member 24. In a manner subsequently described, the upper mill guide member end portion 24*a* coaxially receives and is secured to a lower end portion of a tubular milling pipe 30 having a generally disc-shaped first rotary mill bit 32 affixed to its lower end. When the mill guide member end portion 24*a* is initially installed on the mill pipe 30, the bottom end of the milling bit 32 is downwardly adjacent the open lower end of the mill guide member end portion 24*a* as schematically indicated in FIG. 1A.

With the tubular fishing neck 74, mill guide 24 and anchor assembly 22 secured to the lower end of the milling pipe 30 as shown in FIG. 1A, the milling pipe 30 is lowered into the casing 12 until, as indicated in FIG. 1A, the mill guide member 24 is in a predetermined vertical position and rotational orientation within the casing 12 relative to the desired location of the casing window 16 (see FIG. 2) to be subsequently formed. During its run-in, the overall milling and anchor structure may be rotationally oriented within the casing 12 utilizing, for example, a conventional gyroscope.

After the anchor assembly 22 and its associated mill guide member 24 are vertically and rotationally oriented within the casing 12, the anchor assembly 22 is hydraulically set, in a manner subsequently described herein, using pressurized fluid within the milling pipe 30. The setting portion of the anchor assembly 22 includes an annular elastomeric trash barrier seal member 36 coaxially carried by the anchor assembly 22 downwardly adjacent its upper end 38; a circumferentially spaced series of upper slips 40 below the seal member 36; and a circumferentially spaced series of lower slips 42 below the upper slips 40. The setting process moves the seal member 36, and the slips 40 and 42, radially outwardly into gripping engagement with the facing inner side surface of the casing 12, thereby rotationally and translationally locking the anchor assembly 22 (and thus the mill guide member 24 and the tubular fishing neck 74 as well) within the casing 12.

With the anchor assembly 22 set in the casing 12, the milling pipe 30 is forcibly moved in a vertical direction to break it free from the tubular upper end portion 24*a* of the mill guide member 24. The milling pipe 30 is then rotationally driven (representatively in a clockwise direction as viewed from above) and further lowered through the fishing neck 74 and upper mill guide member end portion 24 into casing 12, as indicated by the arrow 44 in FIG. 1A, parallel to the vertical casing axis 46. When the rotating mill bit 32 engages the sloping mill guide member surface 28 the bit is laterally deflected to the left, as indicated by the arrow 48 in FIG. 1A, into engagement with the casing 12 to thereby form an initial window opening 16*a* therein. After the formation of this initial casing window opening 16*a*, the rotation of the milling pipe 30 is stopped, and the milling pipe 30 and mill bit 32 are pulled upwardly through the upper mill guide member end portion 24*a* and attached fishing neck 74 and out of the casing 12, leaving the anchor assembly 22, the mill guide member 24, and the tubular fishing neck 74 in place within the casing 12.

The first mill bit 32 is then replaced with a second mill bit 52 (see FIG. 1B) on the lower end of the withdrawn milling pipe 30, the second bit 52 having a generally conical leading end portion 52*a*. Additionally, a specially designed tubular retrieval collet structure 54 is coaxially secured to the withdrawn milling pipe 30 somewhat above the second mill bit 52. As schematically shown in FIG. 1B, the withdrawn milling pipe 30 is then lowered into the casing 12, and through the tubular fishing neck 74, until the mill bit 52 downwardly exits the upper mill guide member end portion 24*a*. The milling pipe 30 is then rotated and further lowered, as indicated by the arrow 56 in FIG. 1B. As the rotating mill bit 52 contacts the sloping mill guide surface 28 the bit 52 is leftwardly deflected, as indicated by the arrow 58, into engagement with the casing 12 and downwardly enlarges the previously milled casing side wall opening 16*a* (see FIG. 1A) to form the desired casing window opening 16 shown in both FIG. 1B and FIG. 2.

After this second liner casing step is completed, the rotation of the milling pipe 30 is stopped, and the milling pipe 30 then forced further downwardly to push the retrieval collet structure 54 into the open top end 74*a* of the tubular fishing neck 74. In a manner later described herein, this causes the collet structure 54 to latch itself within the interior of the fishing neck 74. The milling pipe 30 is then pulled upwardly. In a manner also later described herein, this separates the milling pipe 30 from the latched collet structure 54 and permits the milling pipe 30 to be drawn upwardly through the interiors of the fishing neck 74 and the collet structure 54. A shoulder portion (not shown in FIG. 1B) on the upwardly traveling milling pipe 30 then latches onto the collet structure 54 and transfers the upwardly directed milling pipe retrieval force to an interior portion of the anchor assembly 22, via the collet structure 54 and the mill guide member 24, in a manner releasing the anchor assembly 22 from the casing 12 by retracting the anchor assembly seal and slip portions 36,40 and 42.

The released anchor assembly 22, together with the fishing neck 74 and the mill guide member 24, are then pulled out of the casing 12 on the mill pipe 30 with the latched collet structure 54 and the mill bit 52. It should be noted that, due to the use of the specially designed retrieval collet structure 54, the anchor assembly 22, together with the mill guide member 24 and the fishing neck 74 secured thereto, are retrieved in conjunction with the second milling step (or the first milling step is only one mill bit is used to form the desired casing window 16), and does not require a subsequent separate anchor/mill guide structure retrieval step. After retrieval of the anchor assembly, the mill guide member 24 and the fishing neck 74 as just described, the lateral bore liner 20 may be installed in the casing 12, in a suitable conventional manner, as shown in FIG. 2.

Structure of Anchor 22, Mill Guide 24, and Fishing Neck 74

Figure 3A:
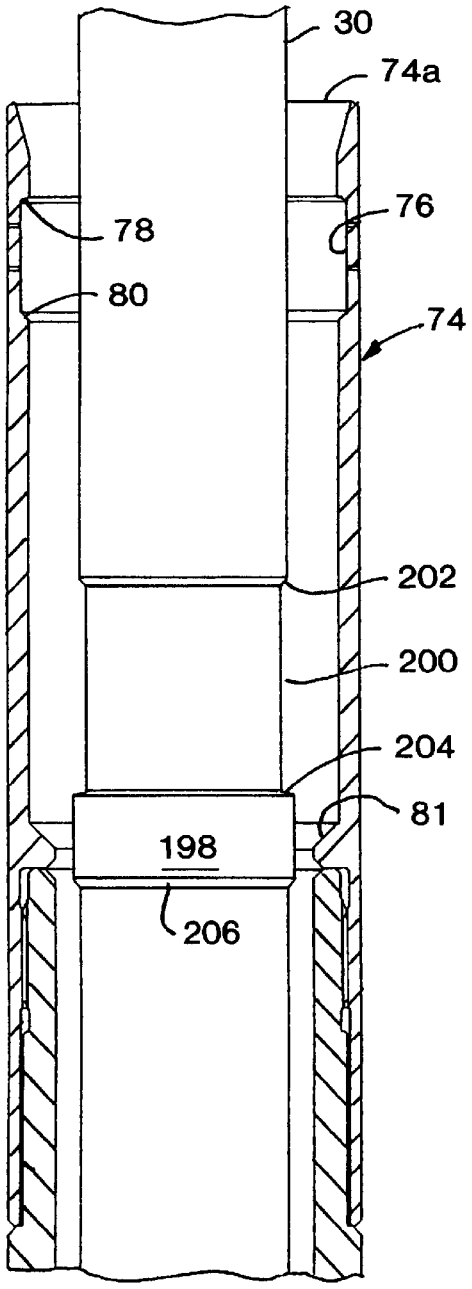
FIGS. 3A–3E are cross-sectional views through downwardly successive longitudinal portions of the milling guide and anchor assembly of the present invention, with the components of the milling guide and anchor assembly being in their initial run-in orientations.
Figure 3B:
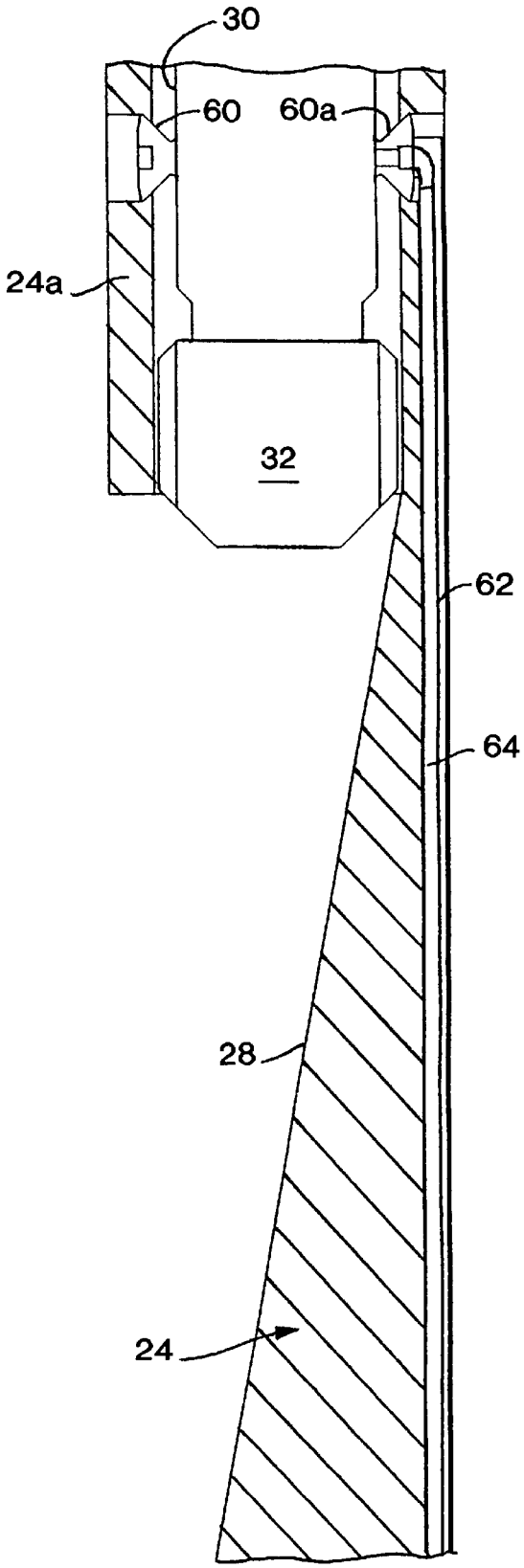
Figure 3C:
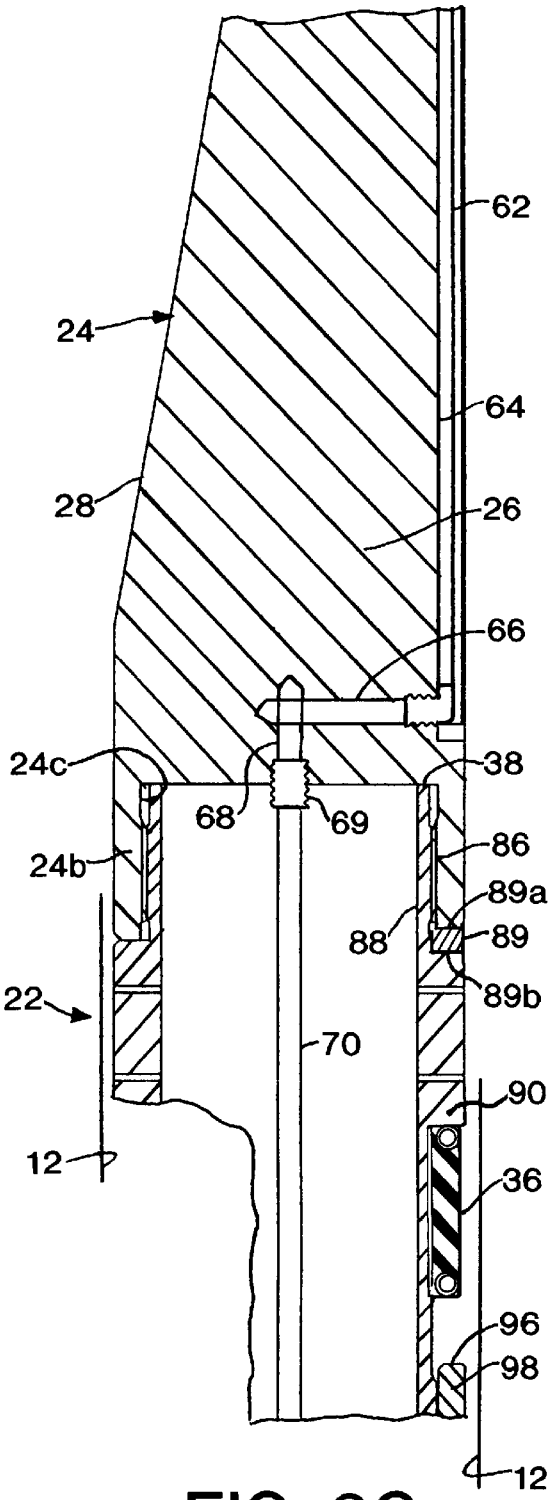
Figure 3D:
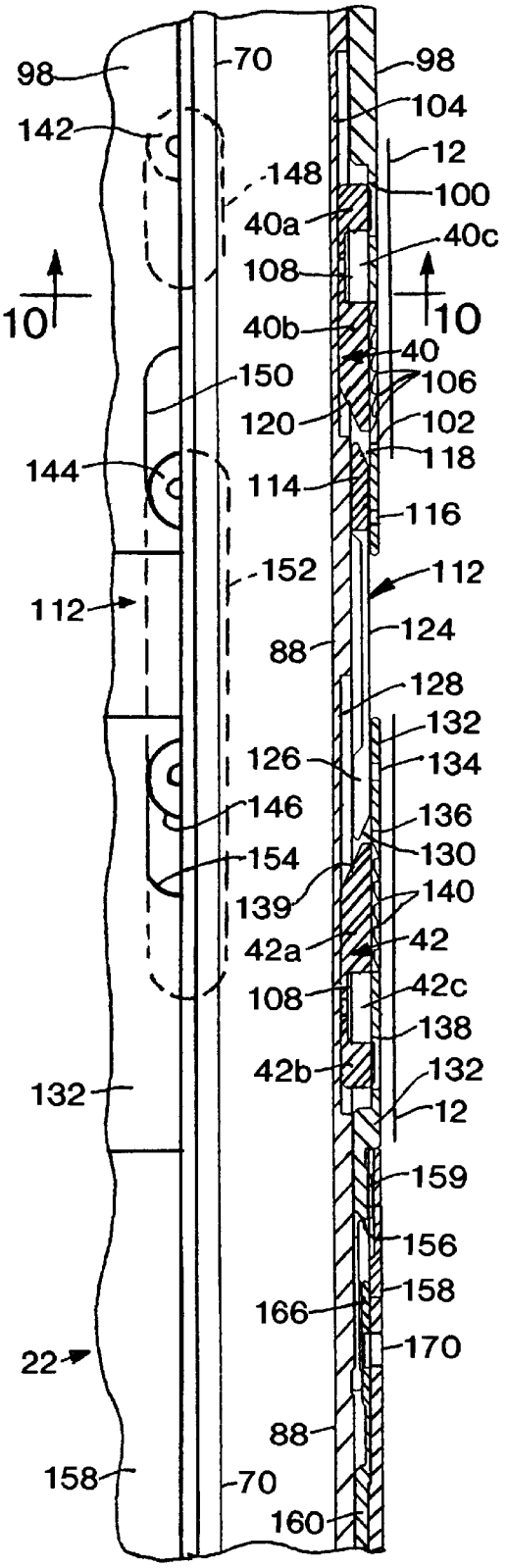
Figure 3E:
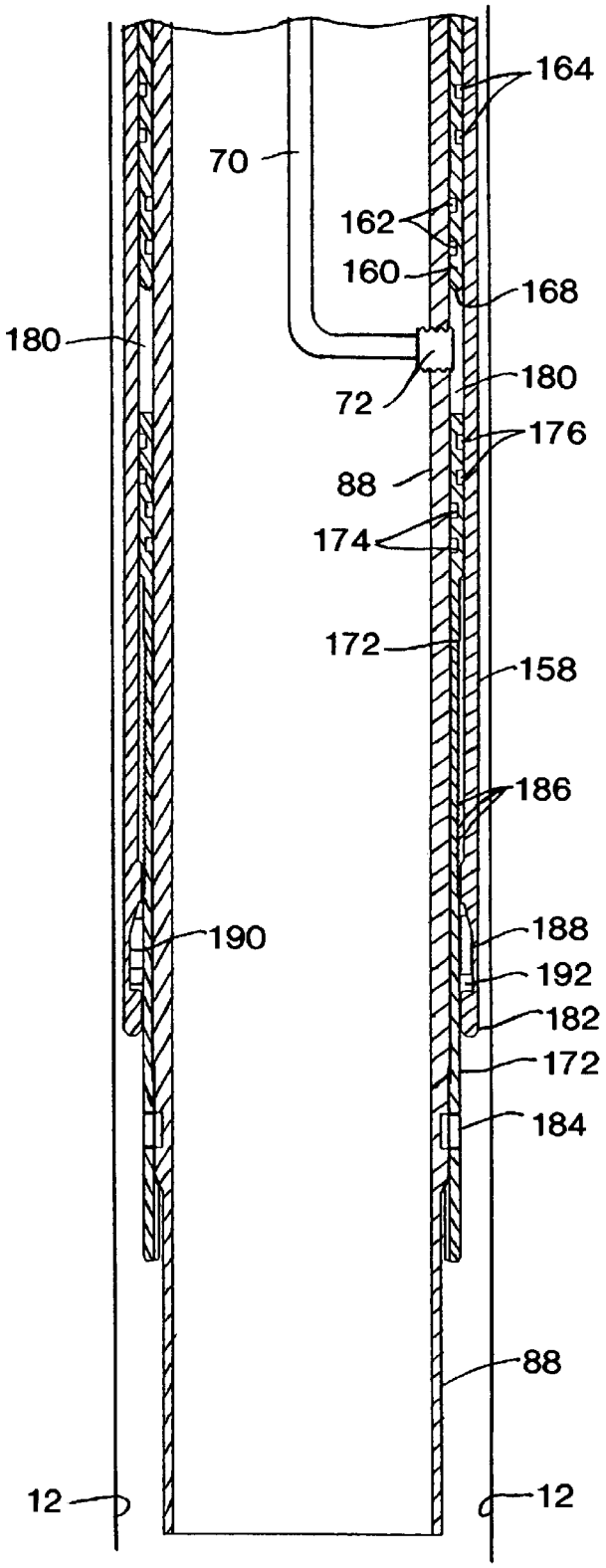
Figure 4A:
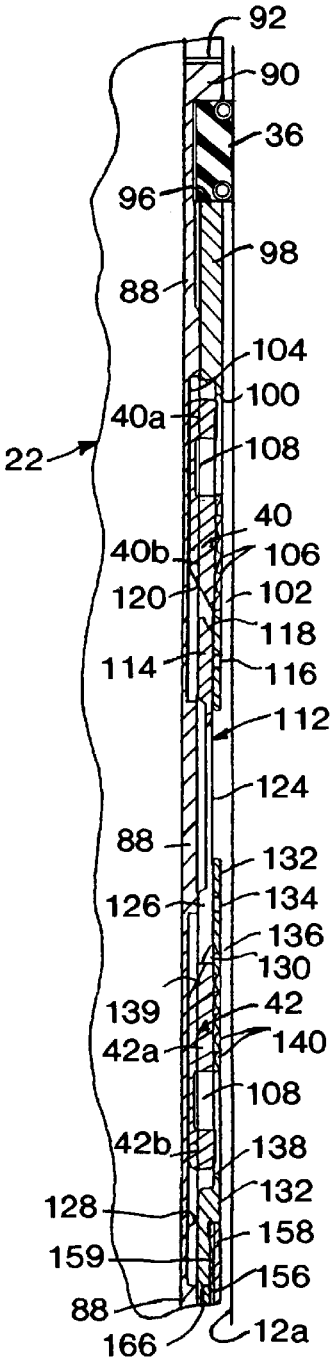
FIGS. 4A and 4B, 5A and 5B, and 6A and 6B are reduced scale partial quarter sectional views of downwardly successive longitudinal portions of the anchor portion of the assembly and sequentially illustrate the setting of the anchor portion in the well casing.

In FIGS. 3A–3E downwardly successive longitudinal portions of the overall anchor, mill guide and fishing neck assembly 22,24,74 of the present invention are cross-sectionally illustrated in greater detail, and at a larger scale, with the milling pipe 30 extending coaxially through the interior of the fishing neck 74 and being shown in elevation. The tubular anchor assembly 22 is shown in FIGS. 3C–3E within the casing 12, with the various relatively shiftable components of the anchor assembly 22 (as later described herein) being in their initial run-in positions. Anchor assembly 22 is substantially similar in construction to the anchor assembly 22 illustrated and described in U.S. application Ser. No. 08/759,508 incorporated by reference herein, but for convenience will be for the most part described in detail herein as well.

The tubular fishing neck 74 (see FIG. 3A) has, adjacent its upper end 74*a*, an annular interior side surface recess 76 having a downwardly and radially outwardly sloped upper annular end ledge surface 78, and a downwardly and radially inwardly sloped lower annular end ledge surface 80. Near its lower end the fishing neck 74 has an annular interior stop flange portion 81. The lower end of the fishing neck 74 is threaded, as at 82, exteriorly onto the tubular upper end portion 24*a* of the mill guide member 24. A tubular lower end portion 24*b* of the mill guide member 24, in turn, is threaded as at 86 exteriorly onto main inner mandrel 88 (see FIG. 3C). To prevent relative rotation between the threadingly connected lower mill guide end portion 24*b* and the upper end of the main inner mandrel 88, an anti-rotation lug 89 (see FIG. 3C) is operatively placed in axially facing slots 89*a*,89*b* formed in the mill guide end portion 24*b* and upper end portion of the main mandrel 88.

Immediately below the bottom end portion 24*b* of the mill guide member 24 is an annular outwardly projecting exterior shoulder portion 90 of the main mandrel 88. The previously mentioned annular elastomeric seal member 36 circumscribes the main mandrel 88 and upwardly abuts the downwardly facing annular side surface of the annular mandrel shoulder 90. With the components of the anchor assembly 22 in their run-in orientations shown in FIGS. 3C–3E the bottom end of the seal member 36 (see FIG. 3C) is upwardly spaced apart from the top end 96 of a tubular upper slip carrier 98 (see also FIG. 3D) that outwardly and slidably circumscribes the main mandrel 88.

Turning now to FIG. 3D, a lower end portion of the upper slip carrier 98 has a circumferentially spaced series of upper and lower slip window openings 100,102 that outwardly overlie a series of axially extending pocket areas 104 (see also FIG. 10) formed in and circumferentially spaced around the outer side surface of the main inner mandrel 88. The upper slips 40 are circumferentially spaced around the main mandrel 88, are slidably received in the pocket areas 104, and have upper and lower portions 40*a*,40*b* which are respectively received in the slip windows 100,102. Each of the upper slips 40 has a recessed area 40*c* disposed between its upper and lower portions 40*a* and 40*b*. Lower slip portions 40*b* have exterior side surface gripping teeth 106 formed thereon. Teeth 106 spiral downwardly in a clockwise direction as viewed from above (i.e., in the same rotational direction as the rotation of the milling pipe 30 during the milling operations).

Figure 10:
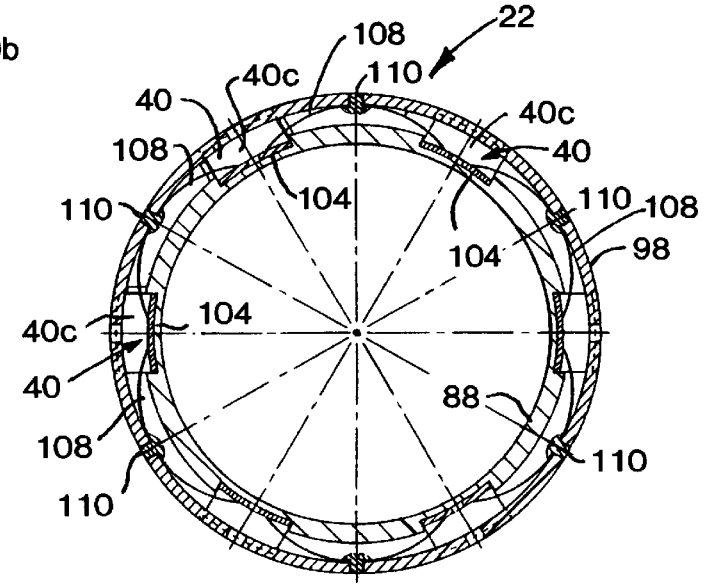
FIG. 10 is an enlarged scale cross-sectional view through the anchor portion of the assembly taken along line 10—10 of FIG. 3D.

With reference now to FIG. 10, the upper slips 40 are resiliently biased in a radially outward direction, in a manner biasing their upper and lower portions 40*a*,40*b* outwardly through their respective slip windows 100 and 102, by means of a unique and highly compact spring system comprising a circumferentially spaced series of elongated arcuate metal spring plate members 108 disposed in the annular space between the main mandrel 88 and the upper slip carrier 98 as illustrated in FIG. 10. Springs 108 are arranged to have their convexly curved sides facing in a radially outward direction, and have longitudinally central portions thereof positioned between circumferentially adjacent pairs of upper slips 40 and anchored to the inner side surface of the upper slip carrier 98 by screws 110.

As illustrated, at each upper slip 40 facing end portions of circumferentially adjacent pairs of springs 108 extend into the recessed slip area 40*c* and slidingly bear on the radially thinned slip portion disposed between the slip-portions 40*a* and 40*b*. When the anchor assembly 22 is set in the casing 12 as subsequently described herein the slips 40 are forced radially outwardly into biting engagement with the casing 12. This radially outward setting movement of the upper slips 40 is resiliently resisted by the springs 108 as their outer ends slide along their associated slip members and are temporarily moved toward straightened orientations by the outwardly moving slips 40. When the radially outwardly directed setting force is removed from the slips 40, the spring end portions return to their FIG. 10 curved orientations, thereby radially retracting the slips 40 toward their FIG. 10 orientations.

Slidingly circumscribing the main mandrel 88 below the upper slips 40 is an annular wedge member 112 (see FIG. 3D). Wedge member 112 has a circumferentially continuous upper end portion 114 that underlies the bottom end of the upper slip carrier 98 and is releasably anchored thereto by two circumferentially spaced shear pins 116. A circumferentially spaced series of sloping, generally planar exterior side surface "flat" areas 118 are formed on the upper wedge end 114 face corresponding sloping interior side surface "flat" areas 120 on the bottom ends of the upper slips 40. When the facing flat areas 118,120 engage upon setting of the slips 40 they serve to prevent undesirable relative rotation between the wedge 112 and the slips 40.

A circumferentially spaced series of axial slits extend upwardly through the wedge 112 to its upper end portion 114, thereby forming on the wedge 112 a circumferentially spaced series of downwardly extending collet finger portions 124. Collet fingers 124, as illustrated in FIG. 3D, are radially thinned relative to the upper wedge end portion 114, and have radially thickened lower end portions 126. With the components of the anchor assembly 22 in their run-in orientations shown in FIGS. 3A–3D, these lower collet finger end portions 126, as shown in FIG. 3B, outwardly overlie a circumferentially spaced series of axially extending pocket areas 128 formed in the exterior side surface of the main mandrel 88.

The lower collet finger end portions 126 have sloping flat exterior side surface areas 130 and underlie an upper end portion of a tubular lower slip carrier 132 that slidably circumscribes the main mandrel 88. Five circumferentially spaced shear pins 134 releasably anchor the upper end of the lower slip carrier 132 to underlying ones of the collet finger lower end portions 126. The circumferentially spaced lower slips 42 are in opposing relationships with the upper slips 40, are slidably carried in the mandrel pockets 128, and have upper and lower portions 42*a*,42*b* which are respectively received in upper and lower slip windows 136,138 formed in the lower slip carrier 132 and outwardly overlying the mandrel pockets 128. Each of the lower slips 42 has a recessed area 42*c* disposed between its upper and lower portions 42*a* and 42*b*. At the upper end of each of the lower slips 42 is a sloping interior side surface flat area 139 which faces a corresponding flat area 130 on one of the wedge member collet fingers 124.

Upper slip portions 42*a* have exterior side surface gripping teeth 140 formed thereon. Teeth 140 spiral downwardly in a counterclockwise direction as viewed from above, thereby having an opposite "hand" than that of the upper slip gripping teeth 106. The lower slips 42 are resiliently biased in a radially outward direction, by springs 108, in a manner identical to that described for the upper slips 40 in conjunction with FIG. 10. Accordingly, when the upper and lower slips 40,42 are set into gripping engagement with the casing 12 as later described herein, they very strongly resist rotation of the anchor assembly 22 relative to the casing 12 in either direction about its vertical axis 46.

Still referring to FIG. 3D, the main inner mandrel 88 is rotationally locked to the upper and lower slip carriers 98 and 132, in a manner permitting relative axial shifting between the mandrel 88 and the slip carriers 98 and 132 as later described herein, by three downwardly successive sets of torque pins 142,144 and 146. Torque pins 142 extend inwardly through the upper slip carrier 98 and are slidably received in axially elongated slots 148 in the inner mandrel. Torque pins 144 extend inwardly through the upper slip carrier 98 and are slidably received in axially elongated slots 150 formed in the upper slip carrier 98 and in substantially longer axially elongated slots 152 formed in the inner mandrel 88. Torque pins 146 extend inwardly through the lower slip carrier 132 and are slidingly received in the mandrel slots 152 and in shorter axially elongated slots 154 formed in the lower slip carrier 132.

With continued reference to FIG. 3D, an annular, downwardly facing exterior ledge 156 is formed on a bottom end portion of the lower slip carrier 132 beneath its lower slip windows 138. This bottom end portion of the lower slip carrier 132 is outwardly overlapped by an upper end portion of a tubular piston retainer member 158 that circumscribes the main mandrel 88 in a radially outwardly spaced relationship therewith. At its upper end, the retainer member 158 is threaded, as at 159, onto the lower slip carrier 132 just above the ledge 156. A tubular piston member 160 (see FIGS. 3D and 3E) is coaxially and slidably carried in the annular space between the mandrel 88 and the piston retainer 158, and is slidingly sealed to the facing side surfaces of the mandrel 88 and piston retainer 158 by the indicated O-ring seals 162 and 164.

Tubular piston 160 has an upper end 166 (see FIG. 3D) downwardly spaced apart from the annular lower slip carrier ledge 156, and a bottom end 168 (see FIG. 3E). As indicated in FIG. 3D, an upper end portion of the piston retainer 158 is releasably anchored to the underlying upper end portion of the piston 160 by shear pins 170. Referring now to FIG. 3E, spaced downwardly apart from the bottom piston end 168 is a tubular slip mandrel 172 which is slidably received in the annular space between the main mandrel 88 and the piston retainer member 158 and slidingly sealed to their facing side surfaces by the indicated O-ring seals 174,176.

The upper end 178 of the slip mandrel 172 is spaced downwardly apart from the bottom end 168 of the tubular piston 160 and forms therewith an annular pressure chamber 180 between the main mandrel 88 and the piston retainer member 158. A lower end portion of the slip mandrel 172 extends downwardly beyond the lower end 182 of the retainer member 158 and is releasably anchored to the main mandrel 88 by a circumferentially spaced series of shear pins 184. A longitudinally extending series of ratchet teeth 186 are formed on the outer side surface of the slip mandrel 172 and are operatively engaged by corresponding teeth on an annular ratchet slip member 188 captively retained in an annular interior side surface pocket 190 formed in a lower end portion of the piston retainer member 158. In a conventional manner the ratchet slip member 188 permits the piston retainer member 158 to move upwardly along the slip mandrel 172 but not downwardly therealong. The ratchet slip member 188 is upwardly biased in the pocket 190 by wave spring members 192 therein.

With reference now to FIGS. 3B–3E, with the overall anchor, mill guide and fishing neck assembly 22,24,74 in their previously described run-in orientations, a lower end portion of the milling pipe 30 (see FIG. 3B) is releasably secured within the tubular upper mill guide portion 24*a* by shearable setting pin members 60, with the illustrated setting pin 60*a* being hollow and communicating the interior of the milling pipe 30 with the upper end of an elongated fluid supply tube 62 which is recessed in a vertically extending groove 64 formed in the exterior side surface of the milling guide member 24 opposite its sloping side surface 28. As illustrated in FIG. 3C, the bottom end of the tube 62 is communicated with interconnected internal passages 66,68 formed in the lower end of the mill guide member 24. Passage 68, in turn, is connected by a threaded fitting 69 to the upper end of a second fluid supply tube 70 that centrally extends downwardly through the anchor assembly 22. As illustrated in FIG. 3E, the lower end of the tube 70 is secured to the inner mandrel 88 by a threaded fitting 72 and communicates with the pressure chamber 180.

For purposes subsequently described herein, as illustrated in FIG. 3A the milling pipe 30 has formed thereon a diametrically enlarged annular exterior flange 198 positioned immediately below an annular exterior side surface groove 200 formed in the milling pipe 30. A downwardly facing annular, upwardly and radially outwardly sloped ledge 202 is formed at the upper side of the annular groove 200; an upwardly facing annular, downwardly and radially outwardly sloped ledge 204 is formed at the upper side of the flange 198; and a downwardly facing annular, upwardly and radially outwardly sloped ledge 206 is formed at the bottom side of the flange 198.

Structure of the Retrieval Collet 54

Figure 7:
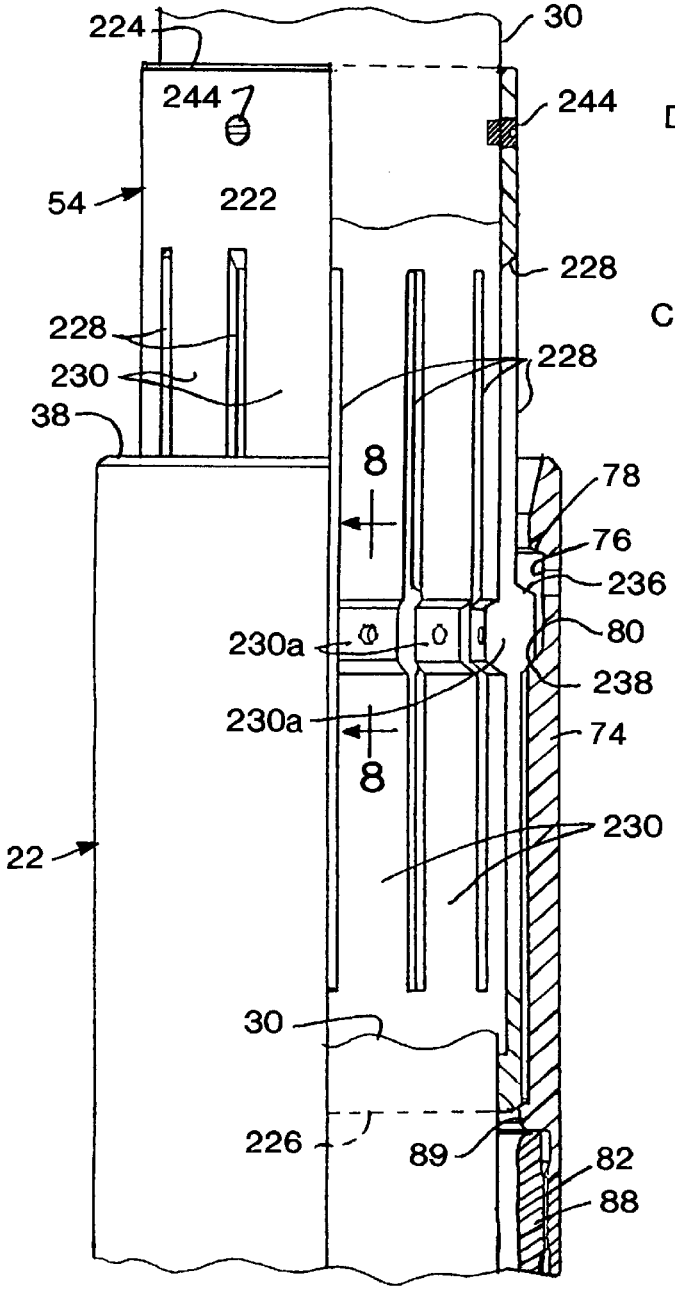
FIG. 7 is a quarter sectional view of a tubular upper end portion of the milling guide illustrating its receipt of a specially designed double-ended retrieval collet structure embodying principles of the present invention.
Figure 8:
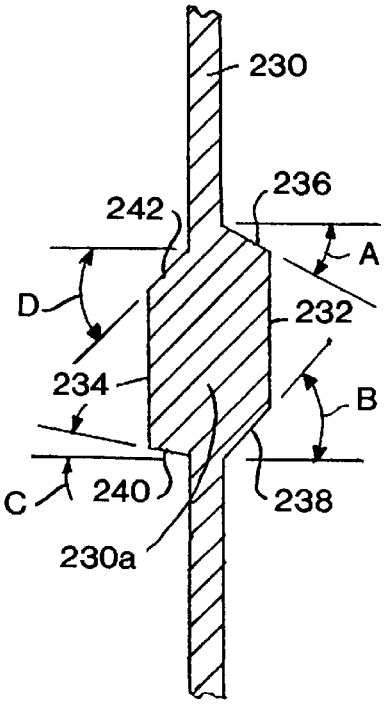
FIG. 8 is an enlarged scale cross-sectional view through a portion of one of the collet structure finger portions taken along line 8—8 of FIG. 7.

Turning now to FIGS. 7 and 8, the retrieval collet 54 has a tubular body 222 with open upper and lower ends 224,226. A circumferentially spaced series of axially extending slots 228 are formed in the body 222, with the top ends of the slots 228 being downwardly spaced apart from the upper end 224 of the collet body 222, and the bottom ends of the slots 228 being upwardly spaced apart from the lower end 226 of the collet body 222. Slots 228 form therebetween a circumferentially spaced series of axially extending double ended collet finger portions 230 which are resiliently deflectable in radially inward and outward directions relative to the balance of the retrieval collet body 222.

As best illustrated in FIG. 8, longitudinally intermediate sections 230*a* of the fingers 230 are radially thickened to form on each finger 230 a radially outwardly extending projection 232 and a radially inwardly extending projection 234. Projection 232 has an upper end surface 236 which is sloped downwardly and radially outwardly at an angle A relative to a reference plane extending transversely to the longitudinal axis of collet body 222, and a lower end surface 238 which is sloped upwardly and radially outwardly at an angle B relative to a reference plane extending transversely to the longitudinal axis of collet body 222. Projection 234 has a lower end surface 240 which is sloped upwardly and radially outwardly at an angle C relative to a reference plane extending transversely to the longitudinal axis of collet body 222, and an upper end surface 242 which is sloped downwardly and radially outwardly at an angle D relative to a reference plane extending transversely to the longitudinal axis of collet body 222.

Relative to a reference plane transverse to the longitudinal axis of the collet body 222, the slope of the end surface 240 is less than the slope of the end surface 236 which, in turn, is less than the slope of the end surface 238. Representatively, the end surface 242 is generally parallel to the end surface 238. Preferably, angle C is approximately 10 degrees, angle A is approximately 20 degrees, and angle B is approximately 45 degrees.

Operation of the Anchor Assembly 22 and Collet Structure 54

When the interconnected milling pipe 30, fishing neck 74, mill guide 24 and anchor assembly 22 are initially run downwardly into the casing 12 to their predetermined FIG. 1A vertical and rotational orientations, the anchor assembly 22 is hydraulically set within the casing 12 by forcing pressurized fluid downwardly through the interior of the milling pipe 30 and, via the tube 62, the passages 66 and 68, and the tube 70 (see FIGS. 3B–3E) into the annular pressure chamber 180 (see FIG. 3E).

Referring now to FIGS. 4A–6B, which sequentially illustrate the operation of the tubular anchor assembly 22, when the hydraulic setting pressure within the chamber 180 reaches a first predetermined magnitude, the resulting upward pressure force on the bottom piston end 168 causes the pins 170 (see FIG. 4B) to shear. This, in turn, causes the pressure in chamber 180 to drive the piston 160 upwardly from its run-in position along the main mandrel 88. The upper end 166 of the piston 160 then strikes the annular ledge 156 on the lower slip carrier 132 (see FIG. 4A) and forces the interconnected lower slip carrier 132, slips 40 and 42, wedge member 112, upper slip carrier 98 and piston retainer 158 upwardly to their positions shown in FIGS. 4A and 4B in which the upper end 96 of the upper slip carrier 98 upwardly engages the annular elastomeric seal member 36, axially compresses it, and radially outwardly deforms it into sealing engagement with the inner side surface of the casing 12.

Figure 5A:
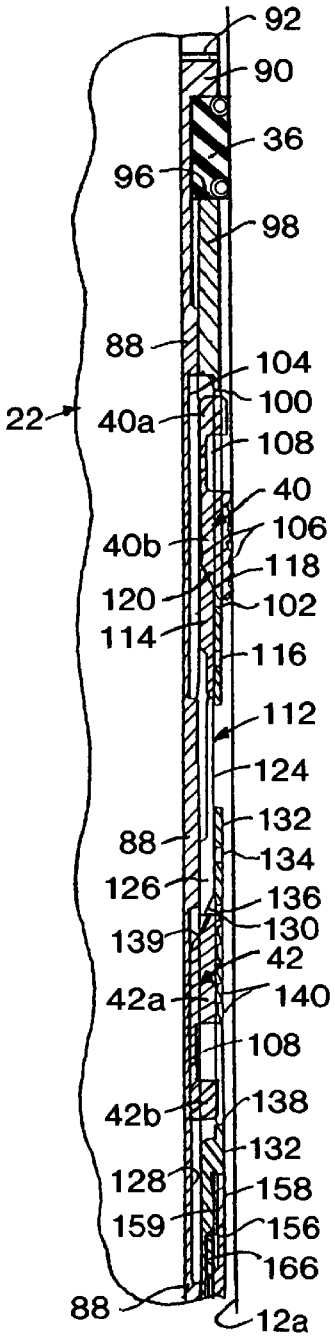
Figure 5B:
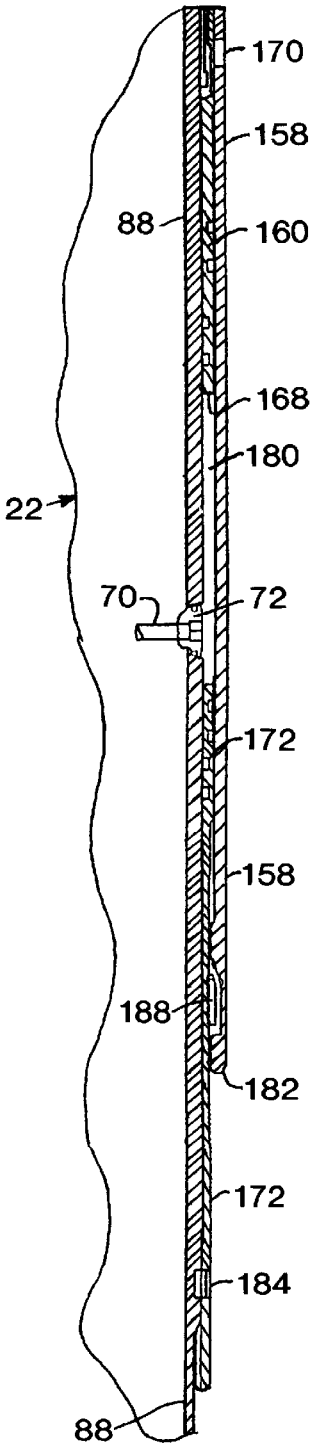

Next, as illustrated in FIGS. 5A and 5B, a further pressure increase in the chamber 180 drives the piston 160 further upwardly along the main mandrel 88 until the pins 116 shear and permit the upwardly moving piston to drive the upper end 114 of the wedge member 112 into forcible camming engagement (via the facing wedge and slip surfaces 118, 120) with the upper slips 40, thereby radially driving the upper slips 40, against the resilient biasing forces of their associated springs 108, outwardly into setting engagement with the casing 12 as shown in FIG. 5A. At this point, the bottom ends 126 of the wedge member collet fingers 124 are moved upwardly past the mandrel pockets 128 and are radially supported by an underlying, nonpocketed outer side surface portion of the main mandrel 88.

Figure 6A:
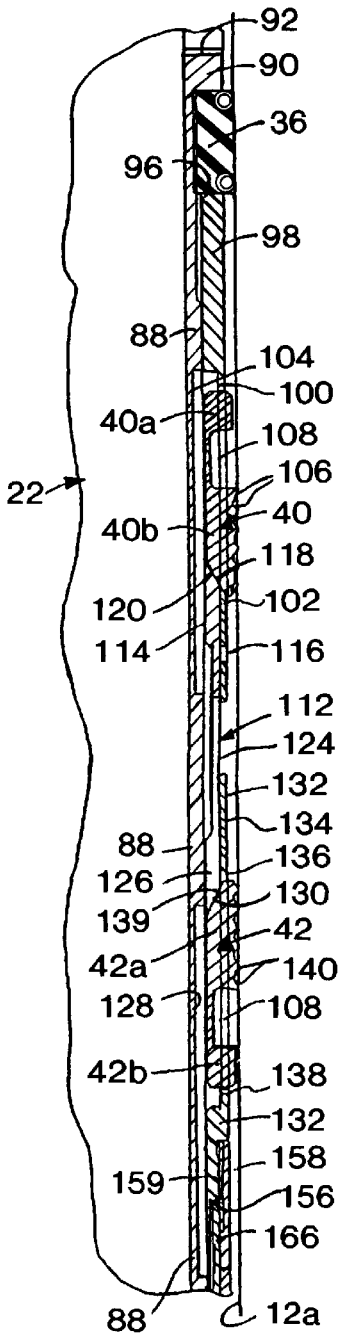
Figure 4B:
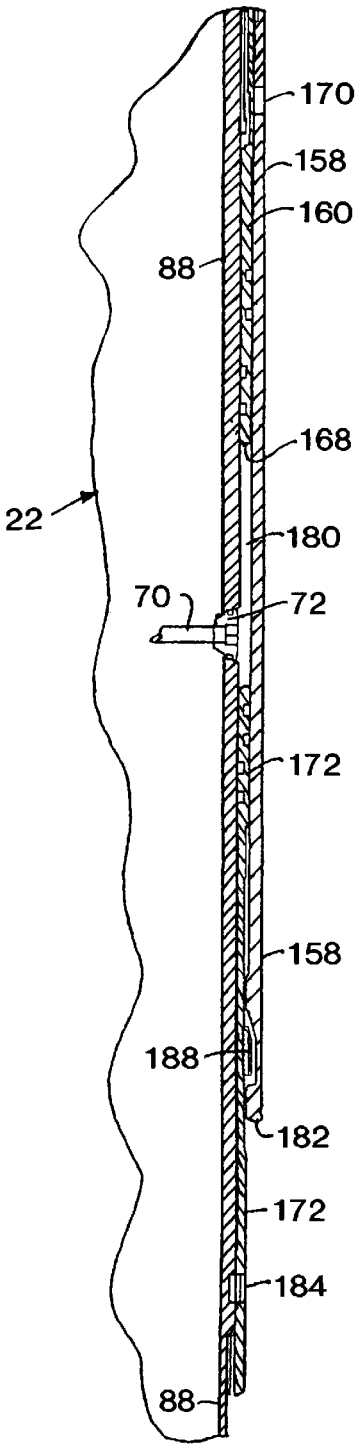
Figure 6B:
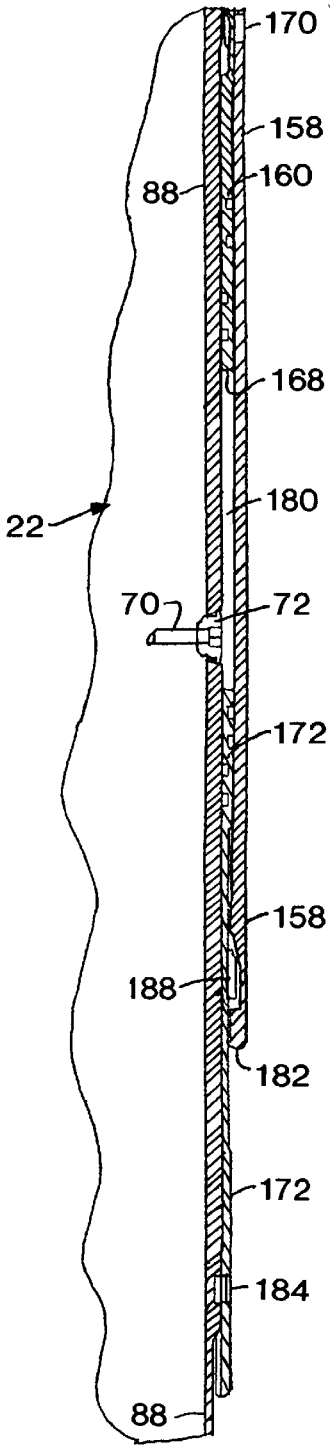

Finally, as illustrated in FIGS. 6A and 6B, a further increase in pressure within the chamber 180 shears the pins 134 and causes the piston 160 to move further upwardly along the main mandrel 88 in a manner bringing the facing wedge and lower slip member surfaces 130,139 into forcible camming engagement, thereby radially driving the lower slips 42, against the resilient biasing forces of their associated springs 108, outwardly into setting engagement with the casing 12 as shown in FIG. 6A.

With the anchor assembly 22 set in the casing 12 in this manner, the milling pipe 30 is freed from the tubular upper mill guide end portion 24*a* (see FIG. 3B) by forcibly moving the milling pipe 30 up and down to shear its setting pins 60,60*a*. The freed milling pipe 30 is then lowered and rotated to perform the first milling step previously described herein in conjunction with FIG. 1A.

The milling pipe 30 is then upwardly removed from the casing 12, leaving the anchor assembly 22, the mill guide 24 and the fishing neck 74 secured therein, and readied for the second milling step previously described herein in conjunction with FIG. 1B. Specifically (as shown in FIG. 7) the retrieval collet structure 54 is coaxially secured to the milling pipe 30 with shearable mounting screws 244, and the first mill bit 32 (see FIG. 1A) is replaced with the second mill bit 52 (see FIG. 1B). Milling pipe 30 is then again lowered into the casing 12, and the second milling step previously described herein in conjunction with FIG. 1B is performed.

Referring now to FIG. 7, after this second milling step is performed, the milling pipe 30 is pushed downwardly to cause the retrieval collet structure 54 to enter the top end 224 of the fishing neck 74. As the collet structure 54 enters the fishing neck 74, the outer collet finger projections 232 are radially inwardly deflected by an upper interior end surface portion of the fishing neck 74 and then resiliently snap radially outwardly into the interior fishing neck recess 76. The downward insertion movement of the collet structure 54 through the fishing neck 74 is automatically limited by the interior fishing neck flange 89 which functions as an abutment for the lower end 226 of the collet structure 54.

While the relatively shallow lower shoulder surface angle B of the outer collet projections 232 permits the projections 232 to be readily deflected inwardly to then permit them to outwardly snap into the fishing neck recess 76, the much more steeply sloped upper shoulder surface angle A essentially prevents the outer collet finger projections 232 from exiting the recess 76 when the collet structure 54 is pulled upwardly relative to the anchor assembly 22. As indicated in FIG. 7, the upper fishing neck annular interior ledge 78 is essentially parallel to the outer collet finger projection upper end surfaces 236, and the lower fishing neck annular interior ledge 80 is essentially parallel to the outer collet finger projection lower end surfaces 238.

Figure 9:
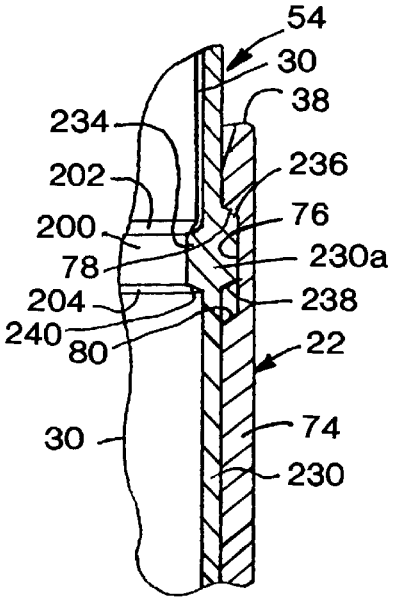
FIG. 9 is a partial quarter sectional view through an upper end portion of the mill guide and illustrated a locking engagement between the collet structure and the milling pipe during a mill guide and anchor assembly retrieval operation.

With the one-way collet structure 54 locked into place in this manner within an upper end portion of the fishing neck 74, the milling pipe 30 is pushed further down the casing 12 to shear the collet mounting pins 244 to thereby free the milling pipe 30 from the collet structure 54. The now freed milling pipe 30 is then pulled upwardly relative to the collet structure 54, thereby raising the second mill bit 52 (see FIG. 1B) back into a lower end portion of the anchor structure 22, while at the same time also upwardly moving the annular milling pipe outer side surface groove 200 (see FIG. 3A) toward the inner collet finger projections 234 (see FIGS. 7–9).

As the milling pipe annular ledge 204 upwardly engages the downwardly facing annular surfaces 240 of the inner collet finger projections 234, further upward movement of the milling pipe relative to the collet structure 54 is stopped, and the upward retrieval force being exerted on the milling pipe 30 is transferred to the inner mandrel 88 via the collet structure 54, the fishing neck 76 and the mill guide member 24. This upward retrieval force now being transferred to the main mandrel 88 shears the pins 184 (see the bottom of FIG. 6B), thereby permitting the fishing neck 76, the mill guide member 24 and the main mandrel 88 to be pulled upwardly relative to the balance of the anchor assembly 22, thereby returning the main mandrel 88 to its initial run-in position shown in FIGS. 3C–3E.

In turn, this permits the upper and lower slips 40,42 to retract, and the annular seal member 36 to return to its axially uncompressed run-in configuration, thereby releasing the anchor structure 22 and permitting it to be pulled out of the casing 12 along with the milling pipe 30, the collet structure 54, the fishing neck 74 and the mill guide member 24. Quite advantageously, this allows removal of the anchor structure 22 in conjunction with the second milling step instead of requiring a subsequent separate run down the casing to secure and retrieve the anchor apparatus.

After the shearing of the pins 184, the upward movement of the main mandrel 88 creates in the anchor assembly 22 the following release sequence via interactions between the torque pins 142,144,146 and their associated slots 148,150, 152 and 154 shown in FIG. 3D. First, the upwardly moving inner mandrel 88 picks up the torque pins 142, thereby upwardly moving the upper slip carrier 98 and moving the upper slips 40 off the upper end 114 of the wedge 112 to thereby permit the upper slips to retract. Next, the torque pins 144 are picked up and upwardly moved by the mandrel 88 to thereby move the wedge 112 upwardly off the lower slips 42 to permit them to retract. Finally, the torque pins 146 are picked up to thereby pick up the lower slip carrier 132 and eliminate any further relative movement among the slip and wedge parts of the assembly 22.

The uniquely configured anchor assembly 22 with its upwardly projecting mill guide portion 24, and the retrieval collet structure 54, provide a variety of desirable advantages over conventional downhole milling apparatus and associated methods. For example, as can readily be seen in FIGS. 3C–3E, compared to conventionally configured tubular anchoring devices (such as packers) the anchor assembly 22 has quite a thin overall sidewall thickness, with a maximum of three metal member thicknesses along its entire length. Because it is substantially thinner than conventionally constructed downhole anchoring devices the anchor assembly 22, for a given outer diameter, provides an appreciably larger interior diameter to correspondingly provide easier passage therethrough of various tools and other structures.

In the present invention this reduced wall thickness attribute is provided in part by the provision of the previously described main mandrel pockets 104,128 (see FIG. 3D) in which radially inner side portions of the upper and lower slips 40,42 are recessed and slidably carried to thereby position the outer sides of the slips further inwardly in their run-in positions. These pockets 104 and 128, in conjunction with the specially designed colleted wedge member 112, also facilitate the release of the opposing upper and lower slips 40,42 in response to the pulling up of the main mandrel 88 relative to the balance of the anchor assembly 22 as previously described herein.

Specifically, as the main mandrel 88 is pulled upwardly relative to the balance of the previously set anchor assembly 22, the upper slips 40 (via the contacting ramped wedge and slip surfaces 118,120) exert a downward force on the upper end of the wedge member 112. Because of the colleted configuration of the lower portion of the wedge member 112, downward releasing motion of the wedge member 112 is permitted due to a simultaneous radially inward flexing of the collet fingers 124 into the underlying mandrel pockets 128 as the wedge member 112 is forcibly moved downwardly along the main mandrel 88.

Also contributing to the desirable reduction in total wall thickness in the anchor assembly 22 are the specially configured and positioned slip biasing spring members 108 shown in FIG. 10. The shape of these springs, and the way then operatively engage their associated slips, permits them to perform their intended biasing function in the narrow annular space between the main mandrel 88 and their associated slip carrier (carrier 98 or 132 as the case may be).

In addition to these and other desirable configurational attributes, the anchor assembly 22 also has substantially improved stability and retrievability characteristics. For example, because the gripping teeth on the upper and lower slips 40,42 spiral in opposite directions relative to the vertical casing axis 46, the in place anchor assembly 22 is able to strongly resist torsionally created rotational displacement in either direction relative to the casing 12. Additionally, as previously described herein, by using the specially designed one way tubular collet structure 54, the anchor assembly 22 can be released and retrieved in conjunction with a milling operation as opposed to having to retrieve the anchor assembly in a subsequent separate retrieval operation requiring an additional downhole trip.

Additionally, if the intended anchor assembly retrieval technique is unsuccessful the structure of the anchor assembly 22 permits it to be partially milled out, to permit a secondary retrieval process to be carried out, without the anchor assembly falling further down the casing 12 and necessitating a fishing-out process. Specifically, if the anchor assembly 22 becomes stuck in the casing 12 such that it cannot be pulled up on the milling pipe 30, the upward force on the milling pipe 30 can simply be increased to the point where an annular radially thinned safety shear portion 24*c* interiorly formed in the lower mill guide end portion 24*a* (see FIG. 3C) pulls apart, in which case the fishing neck 74 and the portion of the mill guide 24 above the threaded connection will be pulled up on the milling pipe 30, leaving the still set anchor assembly 22 in the casing 12. Appropriate milling apparatus can then be lowered into the casing 12 and used to downwardly mill away a top part of the remaining anchor assembly 22 to just below the upper slips 40.

As can be seen in FIG. 3D, the gripping teeth 140 on the lower slips 42 are, in cross-section, angled downwardly so that from a vertical standpoint the lower slips 42 serve primarily to prevent downward movement of the set anchor assembly 22 through the casing 12. Accordingly, after the milling away of the upper slips 42, and the removal of the milling apparatus from the casing 12, the remaining lower slips 42 hold the balance of the anchor assembly 22 in place and prevent it from simply falling further down the casing 12. The balance of the anchor assembly 22 can then be removed from the casing 12 using, for example, conventional spearing apparatus.

The foregoing detailed description is to be clearly understood as being given by way of illustration and example only, the spirit and scope of the present invention being limited solely by the appended claims.

What is claimed is:

1. Subterranean well bore casing milling apparatus comprising:

a tubular anchor assembly coaxially and releasably securable in the casing and including:

a tubular inner mandrel;

a tubular slip carrier coaxially circumscribing the inner mandrel in a radially outwardly spaced relationship therewith, the slip carrier having a circumferentially spaced series of side wall slip windows therein and outwardly bounding an annular space between the inner mandrel and the slip carrier;

a circumferentially spaced series of slips carried in the annular space for radial movement through the slip windows between retracted and extended positions;

a circumferentially spaced series of arcuate, elongated spring members disposed in the annular space and resiliently biasing the slips toward their retracted positions, the spring members being interdigitated with the slips and having longitudinally central portions secured to the slip carrier, with each slip being engaged by end portions of two spring members on circumferentially opposite sides thereof; and a top end portion adapted for connection to a lower end portion of an elongated mill guide member.

2. The subterranean well bore casing milling apparatus of claim 1 further comprising:

an elongated mill guide member having a lower end portion connected to the top end portion of the tubular anchor assembly.

3. The subterranean well bore casing milling apparatus of claim 2 wherein:

the elongated mill guide member has a tubular upper end portion, and the apparatus further comprises a tubular member coaxially secured to the upper mill guide member end portion, and a tubular retrieval member coaxially securable to a milling pipe and being coaxially latchable in the tubular member coaxially secured to the upper mill guide member end portion.

4. The subterranean well bore casing milling apparatus of claim 1 wherein:

the spring members are concavely curved toward the inner mandrel.

5. The subterranean well bore casing milling apparatus of claim 4 wherein:

the slips have radially outer sides with recesses formed therein, and the end portions of the spring members extend into the recesses.

6. The subterranean well bore casing milling apparatus of claim 5 wherein:

the inner mandrel has an outer side surface in which a circumferentially spaced series of axially elongated pockets are formed, the slips are slidably received in the pockets for movement along their lengths, and the end portions of the spring members slidably engage the slips.

7. Subterranean well bore casing milling apparatus comprising;

a tubular anchor assembly coaxially and releasably securable in the casing and including:

a tubular inner mandrel having an outer side surface in which a circumferentially spaced series of elongated axially extending pockets are formed;

a tubular slip carrier coaxially circumscribing the inner mandrel in a radially outwardly spaced relationship therewith, the slip carrier having a circumferentially spaced series of side wall slip windows therein and outwardly bounding an annular space between the inner mandrel and the slip carrier;

a circumferentially spaced series of slips disposed in the annular space, with radially outer portions of the slips being received in the slip windows for movement therethrough between radially retracted and radially extended positions, and radially inner portions received in the pockets for sliding movement along their lengths;

a biasing structure operative to resiliently bias the slips to their radially retracted positions;

a setting structure operative to force the slips from their radially retracted positions to their radially extended positions; and a top end portion adapted for connection to a lower end portion of an elongated mill guide member.

8. The subterranean well bore casing milling apparatus of claim 7 further comprising:

an elongated mill guide member having a lower end portion connected to the top end portion of the tubular anchor assembly.

9. The subterranean well bore casing milling apparatus of claim 8 wherein:

the elongated mill guide member has a tubular upper end portion, and the apparatus further comprises a tubular member coaxially secured to the upper mill guide member end portion, and a tubular retrieval member coaxially securable to a milling pipe and being coaxially latchable in the tubular member coaxially secured to the upper mill guide member end portion.

10. The subterranean well bore casing milling apparatus of claim 8 wherein:

the setting structure includes a pressure chamber within the tubular anchor assembly, the mill guide member has a tubular upper end portion, and the apparatus further comprises a pressurized fluid passage structure extending from the inner side of the tubular mill guide member upper end portion, downwardly through the mill guide member and the tubular anchor assembly, and into the pressure chamber.

11. The subterranean well bore casing milling apparatus of claim 7 wherein the setting structure includes:

a tubular wedge member coaxially and slidably circumscribing the inner mandrel, the wedge member having a circumferentially spaced series of sidewall slots extending axially inwardly through an end thereof and defining a circumferentially spaced series of collet finger portions of the tubular wedge member, the collet finger portions having outer ends that axially oppose end portions of the slips and are rampingly engageable therewith to drive the slips from their radially retracted positions to their radially extended positions.

12. The subterranean well bore casing milling apparatus of claim 11 wherein:

the inner mandrel, the slips, and the wedge member are relatively movable in axial directions between (1) a set position in which the outer ends of the collet finger portions outwardly overlie and are radially supported by nonpocketed areas of the inner mandrel, and rampingly engage the end portions of the slips, and (2) a release position in which the outer ends of the collet finger portions overlie the inner mandrel pockets and may be radially deflected thereinto in response to an axially directed engagement force between the outer ends of the collet finger portions and the end portions of the slips.

13. Milling apparatus for use in a subterranean well casing, comprising:

a tubular anchor assembly coaxially positionable in the well casing, the tubular anchor assembly having upper and lower ends and further having:

coaxial inner and outer tubular portions shiftable in axial directions relative to one another, circumferentially spaced slips carried between the inner and outer tubular portions for radial movement between extended positions in which the slips grip the casing and releasably lock the anchor assembly therein, and retracted positions in which the slips release the anchor assembly from the casing, a setting structure selectively operative to force the slips from their retracted positions to their extended positions, and a release structure operative in response to an upward shifting of the inner tubular portion relative to the outer tubular portion to permit the slips to move from their extended positions to their retracted positions to thereby release the anchor assembly from the casing;

a mill guide structure projecting upwardly from the upper end of the tubular anchor assembly and having a mill bit deflection surface positioned thereon and angled relative to the longitudinal axis of the tubular anchor assembly, the mill guide structure having a lower end portion secured to the inner tubular portion of the tubular anchor assembly, and a tubular upper end portion;

a milling pipe having a lower end and a radially outwardly projecting abutment surface positioned above the lower end of the milling pipe;

a mill bit secured to the lower end of the milling pipe; and a tubular retrieval structure coaxially circumscribing and releasably secured to the milling pipe above the milling pipe abutment surface, the tubular retrieval structure being lockable to the tubular upper end portion of the mill guide structure in response to downward insertion of the retrieval structure into the tubular upper end portion of the mill guide structure, the milling pipe, with the tubular anchor assembly coaxially locked within the casing, being operative to carry out a milling and anchor retrieval operation within the casing by being sequentially:

(1) lowered through the casing and the tubular upper end portion of the mill guide structure and rotationally driven, to cause the mill bit to be engaged and laterally deflected against a side wall portion of the casing by the mill guide deflection surface, (2) further lowered to insert and operatively lock the tubular retrieval structure within the tubular upper end portion of the mill guide structure, and (3) upwardly pulled out of the casing to sequentially free the milling pipe from the tubular retrieval structure, upwardly bring the milling pipe abutment surface into abutting relationship with the retrieval structure to thereby forcibly move the inner tubular portion of the anchor structure relative to its outer tubular portion and activate the release structure, and pull the released anchor structure, together with the mill guide structure projecting upwardly therefrom, out of the casing.

14. The milling apparatus of claim 13 wherein:

the tubular upper end portion of the mill guide structure is defined by a tubular fishing neck member.

15. The milling apparatus of claim 13 wherein the retrieval structure includes:

a tubular body having upper and lower ends, and a circumferentially spaced series of axially extending side wall slots formed in the body and having upper and lower ends respectively spaced axially inwardly of the upper and lower ends of the body, the slots forming therebetween a circumferentially spaced series of axially extending collet fingers resiliently deflectable radially inwardly and outwardly relative to the balance of the body, each of the collet fingers having a radially outwardly extending outer side projection and a radially inwardly extending inner side projection.

16. The milling apparatus of claim 15 wherein:

the tubular upper end portion of the mill guide structure has an annular interior side surface groove, and the outer side projections on the collet fingers are configured to engage and be inwardly deflected by the inner side surface of the tubular upper end portion of the mill guide structure, and then lockingly snap into the annular interior side surface groove, in response to operative insertion of the retrieval structure body into the tubular upper end portion of the mill guide structure.

17. The apparatus of claim 15 wherein:

the inner side collet finger projections have bottom faces which are upwardly and radially outwardly sloped at a first angle relative to a reference plane transverse to the longitudinal axis of the retrieval structure body, the outer side collet finger projections have top faces which are downwardly and radially outwardly sloped at a second angle relative to a reference plane transverse to the longitudinal axis of the retrieval structure body, and the outer side collet finger projections have bottom faces which are upwardly and radially outwardly sloped at a third angle relative to a reference plane transverse to the longitudinal axis of the retrieval structure body, the first angle being less than the second angle which, in turn, is less than the third angle.

18. The apparatus of claim 17 wherein:

the first angle is approximately 10 degrees, the second angle is approximately 20 degrees, and the third angle is approximately 45 degrees.

19. A method of performing a milling operation on a portion of a subterranean well having a casing, the method comprising the steps of:

providing a tubular anchor structure having an upper end from which an elongated mill guide structure longitudinally extends in an upward direction, the mill guide structure having a mill bit deflection surface positioned thereon and angled relative to the longitudinal axis of the tubular anchor structure, and a tubular upper end portion;

coaxially and releasably locking the tubular anchor structure within the casing adjacent the well portion to be milled;

providing a length of milling pipe having a bottom end to which a mill bit is secured, a radially outwardly extending outer side projection disposed above the mill bit, and a tubular retrieval structure coaxially and releasably secured to the milling pipe above the outer side projection;

milling the well portion by lowering the mill bit end of the milling pipe through the tubular upper end portion of the mill guide structure, rotating the milling pipe, and laterally deflecting the rotating mill bit into cutting engagement with the well portion by bringing the mill bit into contact with the mill guide deflection surface;

downwardly pushing the milling pipe further into the casing and responsively causing the retrieval structure to enter and become latched within the tubular upper end portion of the mill guide structure; and retrieving the tubular anchor structure, and its upwardly projecting mill guide structure, by upwardly pulling the milling pipe out of the casing and sequentially (1) causing the milling pipe to break free from the retrieval structure and move upwardly through the retrieval structure, and (2) causing the milling pipe outer side projection to upwardly abut an interior portion of the retrieval structure and responsively create in the tubular anchor structure an upward force that unlocks the anchor structure from the casing and permits it to be pulled out of the casing, with the mill guide structure, on the retrieval structure.

20. The method of claim 19 wherein the milling step is performed on a sidewall portion of the casing in a manner forming a window opening therein.

21. For use in a subterranean well casing, a method of forming a side wall window opening in the casing, the method comprising the steps of:

providing a tubular anchor structure coaxially positionable in the casing and having an upper end from which an elongated mill guide structure longitudinally extends in an upward direction, the mill guide structure having a mill bit deflection surface position thereon and angled relative to the longitudinal axis of the tubular anchor structure, and a tubular upper end portion, the tubular anchor structure having a chamber for receiving a pressurized fluid, and a setting structure drivable by the received pressurized fluid to releasably lock the positioned anchor structure within the casing;

providing a length of milling pipe having a bottom end to which a first mill bit is secured;

coaxially securing the tubular upper end portion of the mill guide structure to the milling pipe, above the first mill bit, with a shearable structure;

communicating the interior of the milling pipe with the anchor structure chamber;

lowering the mill guide structure and tubular anchor structure an the milling pipe downwardly through the casing to a predetermined position therein;

releasably locking the tubular anchor structure within the casing by flowing a pressurized fluid from the interior of the milling pipe into the anchor structure chamber;

axially moving the milling pipe relative to the tubular upper end portion of the mill guide structure to separate the milling pipe therefrom;

forming an initial window opening the casing by lowering and rotating the milling pipe, and laterally deflecting the rotating first mill bit into cutting engagement with the casing by bringing the rotating first mill bit into contact with the mill guide deflection surface;

upwardly removing the milling pipe from the casing;

installing a second mill bit on the lower end of the milling pipe;

coaxially and releasably securing a tubular retrieval structure to the milling pipe above its lower end;

enlarging the initial window opening in the casing by lowering the milling pipe through the casing, and the second mill bit through the tubular upper end portion of the mill guide structure, rotating the milling pipe, and laterally deflecting the rotating second mill bit into cutting engagement with the casing by bringing the rotating second mill bit into contact with the mill guide deflection surface;

downwardly pushing the milling pipe further into the casing and responsively causing the retrieval structure to enter and become latched within the tubular upper end portion of the mill guide structure; and retrieving the mill guide structure and the tubular anchor structure by upwardly pulling the milling pipe out of the casing and sequentially (1) causing the milling pipe to break free from the retrieval structure and move upwardly through the retrieval structure, and (2) causing a portion of the milling pipe to upwardly abut an interior portion of the retrieval structure and responsively create in the tubular anchor structure an upward force that unlocks the anchor structure from the casing and permits it to be pulled out of the casing, together with the mill guide structure, on the retrieval structure.

* * * * *